US006540130B1

(12) United States Patent
Rödhammer

(10) Patent No.: US 6,540,130 B1
(45) Date of Patent: Apr. 1, 2003

(54) PROCESS FOR PRODUCING A COMPOSITE MATERIAL

(76) Inventor: Peter Rödhammer, Kirchweg 20, A-6600 Reutte (AT)

( * ) Notice: Subject to any disclaimer, the term of this patent is extended or adjusted under 35 U.S.C. 154(b) by 0 days.

(21) Appl. No.: 09/155,258

(22) PCT Filed: Mar. 26, 1997

(86) PCT No.: PCT/AT97/00062

§ 371 (c)(1),
(2), (4) Date: Mar. 31, 1999

(87) PCT Pub. No.: WO97/36015

PCT Pub. Date: Oct. 2, 1997

(30) Foreign Application Priority Data

Mar. 27, 1996 (AT) ..... 171/96 U

(51) Int. Cl.[7] ..... B23K 31/02; B23B 15/00
(52) U.S. Cl. ..... 228/265; 428/614
(58) Field of Search ..... 228/265, 193, 228/194, 198; 428/614

(56) References Cited

U.S. PATENT DOCUMENTS

| | | | | |
|---|---|---|---|---|
| 3,270,412 A | | 9/1966 | Vordahl | |
| 3,634,132 A | * | 1/1972 | Camahort et al. | 117/169 R |
| 3,762,026 A | * | 10/1973 | Shapiro | 29/420 |
| 3,768,987 A | * | 10/1973 | Forstmann et al. | 148/277 |
| 3,795,042 A | * | 3/1974 | Kreider et al. | 29/472.3 |
| 3,885,959 A | * | 5/1975 | Badia et al. | 75/138 |
| 3,895,923 A | * | 7/1975 | Wakefield | 29/191 |
| 3,945,555 A | | 3/1976 | Schmidt | |
| 4,611,390 A | * | 9/1986 | Tanaka et al. | 29/599 |
| 4,738,389 A | * | 4/1988 | Moshier et al. | 228/198 |
| 4,809,903 A | * | 3/1989 | Eylon et al. | 228/194 |
| 4,820,355 A | * | 4/1989 | Bampton | 148/535 |
| 4,853,294 A | * | 8/1989 | Everett et al. | 428/614 |
| 5,035,957 A | * | 7/1991 | Bartlett et al. | 148/DIG. 117 |
| 5,045,407 A | | 9/1991 | Ritter | 428/614 |
| 5,070,591 A | | 12/1991 | Quick et al. | 29/527.4 |
| 5,134,039 A | * | 7/1992 | Alexander et al. | 428/614 |
| 5,211,776 A | * | 5/1993 | Weiman | 148/525 |
| 5,244,748 A | * | 9/1993 | Weeks, Jr. et al. | 428/614 |
| 5,316,797 A | * | 5/1994 | Hazlebeck et al. | 427/376.2 |
| 5,350,637 A | * | 9/1994 | Ketcham et al. | 428/539.5 |
| 5,419,868 A | * | 5/1995 | Honorat | 419/4 |
| 5,470,612 A | * | 11/1995 | Hotaling et al. | 427/377 |
| 5,503,794 A | * | 4/1996 | Ritter et al. | 419/28 |
| 5,518,597 A | * | 5/1996 | Storer et al. | 204/192.38 |
| 5,702,829 A | * | 12/1997 | Paidassi et al. | 428/610 |
| 5,707,409 A | * | 1/1998 | Martin et al. | 427/380 |
| 5,756,207 A | * | 5/1998 | Clough et al. | 428/375 |
| 5,799,238 A | * | 8/1998 | Fisher, II | 419/7 |
| 5,851,686 A | * | 12/1998 | Aghajanian et al. | 428/614 |
| 5,858,465 A | * | 1/1999 | Hunt et al. | 427/248.1 |
| 6,024,898 A | | 2/2000 | Steibel et al. | 264/29.1 |
| 6,117,533 A | * | 9/2000 | Inspektor | 407/119 |

FOREIGN PATENT DOCUMENTS

| | | |
|---|---|---|
| CA | 999057 | 10/1976 |
| WO | WO 93/02222 | 2/1993 |

OTHER PUBLICATIONS

Japanese Abstract 02133550, publishes May 22, 1990.
Japanese Abstract 04246162, published Sep. 2, 1992.
"Homogeneous wrought bodies of multi phase alloys—produced by axially extruding coiled diffusion–alloyed thin strip", Database WPI, *Derwent Publications Ltd.*, Oct. 26, 1976.
International Search Report corresponding to counterpart application PCT/AT97/00062, (7/97).

* cited by examiner

*Primary Examiner*—M. Alexandra Elve
*Assistant Examiner*—L. Edmondson
(74) *Attorney, Agent, or Firm*—Morgan & Finnegan, L.L.P.

(57) ABSTRACT

The invention concerns a process for manufacturing a composite material comprising a matrix component made from one or more metals, or their alloys, chosen from groups IVb to VIb of the Periodic Table, and a strengthening or reinforcing component. According to the invention, the matrix components are processed to form foils, sheets and/or wires and coated with a 1 $\mu$m to 10 $\mu$m thick layer of the strengthening or reinforcing component. A plurality of these coated foils, sheets and/or wires are then combined and permanently joined together by pressure and/or heat.

12 Claims, No Drawings

PROCESS FOR PRODUCING A COMPOSITE MATERIAL

The invention relates to a process of manufacture of a composite material, consisting of a matrix component made from one or more metals or alloys out of groups of IVb to VIb of the periodic table, as well as of a strengthening component.

The high-melting metals titanium, zirconium, hafnium, vanadium, niobium, tantalum, chromium, molybdenum, tungsten and rhenium as well as their alloys exhibit high tensile strength and creep strength at elevated temperatures. The upper limits of application of these materials range from about 650° C. for advanced titanium alloys to about 2200° C. for tungsten alloys. It is characteristic for these materials that these limiting temperatures increase with their density. Especially with regard to components in aerospace, therefore, high-temperature applications of these materials are often ruled out because of their high densities.

Many efforts have been made to improve the hot-strength of the high-melting materials in order to increase their general range of application, and specifically to impart the required hot-strength to those alloys with lower densities preferentially employed for accelerated parts such as in aerospace. Well-known mechanisms accomplishing this are solid-solution and dispersion strengthening as well as precipitation hardening. Full exploitation of these effects requires the strengthening component to be present on an atomic scale (solid solution) or in the sub-micrometer range. For the case of precipitations or dispersoids the limits of these mechanisms are reached whenever the strengthening component either dissolves in the matrix or coalesces to larger particles. Based on one or more of these effects it was possible to push upward by the order of 100° to a few 100° C. the operating temperatures of high-melting alloys. But even then the high-temperature strength attained by these alloys often proved insufficient with regard to the requirements of demanding high-temperature applications.

Light metal and copper-based alloys are routinely reinforced by additions of filaments, platelets, whiskers etc. Generally the manufacture of such alloys is based on melt-metallurgy, sometimes also on pow der metallurgical techniques. Especially the useage of whiskers brings about considerable health hazards.

Manufacture of comparable composite materials based on a matrix made of refractory metals has so far been very limited. The major reason for this lies in the fact that owing to the high processing temperatures which would be required for refractory metals melt-metallurgical processes can hardly be employed. But even the powder-metallurgical processes in use for refractory metals are often not applicable because of the insufficient stability of the available reinforcements at the high temperatures and the long durations required at the stage of sintering.

There has been reported the addition of platelets of hard materials such as titanium diboride or titanium carbide to titanium alloys, whereby an increase in strength by about 30% could be achieved ("Particulate-Reinforced Titanium Alloy Composites Economically Formed by Combined Cold and Hot Isostatic Pressing", Industrial Heating 1993, by Stanley Abkowitz et al ).

There has further been reported the reinforcement of niobium or niobium alloys by incorporation of high-hot-strength wires made of a tungsten/rhenium/bafnium carbide alloy, with a volume content of the latter of more than 50 vol % (see Titran et al, in "Refractory Metals: State of the Art 1988", ed. The Minerals and Metal Society, 1989). Thereby a very significant improvement in strength was achieved, especially in the range of high temperatures up to 1800° C. The disadvantage is that this increase in hot strength is gained at the expense of a strongly increased density of this material. Moreover the wires are not thermodynamically stable and the material ages by way of interdiffusion.

U.S. Pat. No. 3,270,412 describes a process for the manufacture of dispersoid-strengthened metallic materials by multiple rolling of stacks of thin metal foils (e.g. Al or Ti) covered with particles or a thin film of a dispersoid material. Owing to the high deformation encountered by the stack there results a material homogeneously interspersed with particles of the dispersoid ( diameter<1 $\mu$m ). Hence this patent teaches the manufacture of a dispersoid-strengthened material, and not that of a composite material.

In Pat. CA-999 057 there is disclosed a process for the manufacture of multi-phase alloys by way of coating of or lamination of thin sheets of material A ( =matrix ) with a material B (metal or oxide ) and subsequent heat treatment aiming for the formation of intermetallic phases AxBy within the matrix material A. Here material B, deposited e.g. as a coating, diffuses into the matrix and reacts with the latter, forming new intermetallic phases. A serious disadvantage of this concept if applied to high-temperature applications would be that this reaction would further proceed during application and hence no long-term stability of the material properties could be achieved.

A similar idea was put forward in JP 02 133550A. According to this patent an intermetallic compound AxBy is prepared by way of stacking of thin sheets of material A coated with material B, followed by rolling and heat treatment in order to produce the desired alloy by way of diffusion. Although in this case certain process steps that could also lead to a composite material are empoyed, in essence this patent teaches the production of an intermetallic compound.

It is the aim of the present invention to establish a process for the production of a composite material, consisting of a matrix made of one or more metals or alloys thereof chosen from the group Ti, Zr, Hf, V, Nb, Ta, Mo, W and Re as well as of a reinforcing component which circumvents the aforementioned limitations.

According to the present invention the composite is produced by forming the matrix component into foils, thin sheets or wires, by coating these with the reinforcing component to a thickness between 1 $\mu$m and 100 $\mu$m, and by combining a multitude of these foils, thin sheets and/or wires and compacting them unseparably under the action of suitably selected pressures and/or temperatures.

When applying the process according to the present invention there are obtained materials consisting of a multitude of substructures which are put in parallel with regard to the forces exerted during application, and which after their synthesis still exhibit essential morphological features of the original matrix component (the foil, the wire etc. ). Separating these substructures are the undeformed or—depending on the degree of deformation—co-deformed or fragmented layers of the strengthening component. In the latter case these reinforcing fragments attain the form of filaments, platelets or small rods which show a uniform orientation within the matrix.

According to the invention the process will generally be employed to produce a composite material consisting of one single matrix component and one single reinforcing component. But it may also be conceived that the composite will be made up from one or more matrix components combined with one or more different reinforcing components, which allows interesting combinations of materials to be synthesized.

The reinforcing component may consist of one or more compounds or mixtures thereof taken from the group of oxides, carbides, nitrides or borides of the metals of group IVb to VIb as well as of silicon, aluminium and of the rare-earth metals. Furthermore the reinforcing component may consist of a metal, an alloy or an intermetallic compound, or mixtures thereof, selected from the group of niobium, tantalum, chromium, molybdenum, tungsten or rhenium as well as silicon and aluminium, provided that in the case of refractory metals as reinforcing components the latter will have a higher strength than the matrix.

One advantage of the process according to the present invention lies in the fact that the reinforcing component is deposited as a thin, adherent film using established coating processes. In this way all kinds of reinforcing materials become readily accessible at relatively low costs. Moreover the health hazards which are often associated with the production of composite materials are avoided.

The selection of the reinforcing component will firstly be guided by its tensile strength and its modulus of elasticity. In addition the respective coefficients of thermal expansion of reinforcement and matrix must be taken into consideration. Finally the behaviour of the reinforcing component during deformation must be accounted for by suitably selecting the thickness of the reinforcing layer and by adjusting the conditions of deformation. The volume content of the reinforcement will be selected according to the material combination and the required material properties between a few and 50%.

The thicknesses of the foils, sheets or wires used as starting material for the matrix depend on the one hand on the final dimensions of the composite material—the invention calls for a multilayer stacking or multi-stranded twisting—and on the other hand on the degree of deformation during compaction, on the thermo-mechanical mismatch between matrix and reinforcing component, as well as ultimately on the production costs for the starting material. In most applications a compromise between technical and economical considerations bringing to bear the advantages of the composite material per the present invention will be found at thicknesses of the foils, wires etc between 50 $\mu$m and 200 $\mu$m.

For the deposition of the reinforcing component any of the well-known processes of coating or surface modification may be considered. The sole requirement is that the coating thickness or the thickness of the surface-modified zone may be reproduced within the limits of 1 $\mu$m and 100 $\mu$m, and that a dense and flawless layer is reliably achieved.

In case of non-deformable reinforcements the thickness will in general be selected in the lower range between 1 $\mu$m and 10 $\mu$m. This is the case for most carbides, nitrides, borides and oxides of the transition metals, of the rare-earths as well as of silicon and aluminium. Ductile reinforcing components such as tungsten, rhenium or alloys thereof or with other high-melting materials may be advantageously applied also in the upper thickness range up to 100 $\mu$m. The coating thicknesses are in each case selected such that they do not exceed 10% and 50% of the thickness of the prematerial of the matrix for brittle and deformable reinforcements, respectively.

The process according to the invention is carried out in such a way that the reinforcing component is present already at the point of its deposition and that it is sufficiently stable against reactions with the matrix during subsequent production steps as well as during application of the reinforced part. Here "sufficient" means that the major part of the reinforcing component preserves its chemical composition and further that the minor reaction products do not adversely affect the strength of the composite material.

Particularly well suited for the deposition of the reinforcing component are PVD processes such as Arc Ion Plating or Magnetron Sputtering, which upon suitable selection of deposition parameters yield dense, fine-grained and very strong films of carbides, nitrides, borides and oxides.

For the composite materials produced according to the present invention it was totally unexpected that at low volume contents of the reinforcing component there was observed a strengthening significantly higher than that calculated from the rule-of-mixtures. At the same time in bending tests there was observed for W and Mo reinforced per the present invention a lowering of the apparent ductile-to-brittle transition temperature by several 100° C. to below room temperature. In tensile tests the fracture elongation of the composite materials per the present invention as compared to the un-reinforced matrix is reduced, but over the whole range of operating temperatures an elongation >3% can be maintained.

A preferred embodiment of the present invention employs Nb or Ta or alloys thereof as matrix material and a carbide, oxide or nitride (or mixtures thereof) of Ti, Zr or Hf as reinforcing component. Such composite materials exhibit a very favorable ratio of high-temperature strength to density and are hence particularly well suited for applications in the aerospace sector.

In another preferred embodiment the invention is applied to Mo or W or alloys thereof as matrix material and a carbide, oxide or nitride (or mixtures thereof) of Ti, Zr or Hf as reinforcing component. Such composite materials exhibit high hot-strengths up to very elevated temperatures and can be used advantageously for high-temperature furnace parts.

A particularly well-suited process for the compaction of the assembly of the individual coated matrix components to form the final composite lies in Hot Isostatic Pressing, which may be followed by mechanical working with a low degree of deformation.

A very cost-effective way of compaction of the individual coated matrix components consist of sole mechanical compaction, e.g. by rolling. In this case as a rule higher degrees of deformation in the range between 50% and 70% will be required.

In order to optimize the morphology, e.g. by the formation of a elongated grains, following the compaction of the individual coated matrix components the composite is advantageously subjected to a suitable heat treatment.

In the following the invention is illustrated at the hand of a practical example.

Molybdenum foils with a thickness of 60 $\mu$m were arc-ion-plated on one side with a zirconia coating of 5 $\mu$m thickness. The coated foils were assembled to a stack of 16 layers and encapsulated into a can made of thin Mo sheet. The canned stack was then rolled (first pass: cross rolling, then: rolling in longitudinal direction in multiple passes) with a total deformation of 50% at temperatures between 1000° C. and 1400° C. Finally the material of the can was removed by machining.

In tensile tests samples prepared from this composite exhibited a yield strength at 1200° C. of 110 MPa, in comparison to the unreinforced reference with 50 MPa. The anisotropy between the longitudinal and the transverse directions was below 20%. The fracture elongations at 1200° C. and at room temperature were determined as 9% and 6%, repectively. The bending strength of the composite was about 20% higher than that of the unreinforced reference. Surprisingly the bending angles at fracture lay between 30° and 90° compared to 4° to 8° only for the reference sheet.

Investigations of the morphology of the reinforced samples showed that grain growth was limited to the plains between the parallel-lying reinforcements. This particular grain stabilization is believed to be responsible for the strengthening beyond the level to be expected from the presence of the strengthening components themselves. In particular owing to the inherent "brick-wall" morphology the enhanced creep strength persists up to far higher temperatures than is the case for doped materials.

In case of non-deformable reinforcements the thickness will in general will be selected in the lower range between 1 $\mu$m and 10 $\mu$m. This is the case for most carbides, nitrides, borides and oxides of the transition metals, of the rare-earths as well as of silicon and aluminum. Ductile reinforcing components such as tungsten, rhenium or alloys thereof or with other high-melting materials may be advantageously applied also in the upper thickness range up to 100 $\mu$m. The coating thicknesses are in each case selected advantageously such that they do not exceed 10% and 50% of the thickness of the prematerial of the matrix for brittle and deformable reinforcements, respectively.

What is claimed is the following:

1. A process for the manufacture of a composite material comprising a matrix component having one or more metals or alloys selected from the group consisting of Ti, Zr, Hf, V, Nb, Ta, Cr, Mo, W and Re; and a reinforcing component selected from the group consisting of carbides, borides, nitrides and oxides of the metals Ti, Zr, Hf, V, Nb, Ta, Cr, Mo and W or those of the elements Si, B, Al or those of the Rare Earth Elements; whereby the matrix component is provided in the form of foils, sheets and/or wires; said reinforcing component is deposited onto the matrix component as a dense coating with a thickness between 1 $\mu$m and 10 $\mu$m, or to a maximum of 15% of the thickness of the matrix component, whichever is less, and a plurality of said coated foils, sheets and/or wires are assembled and compacted under the action of pressure, or pressure and temperature, with the resulting composite material having substructures which are oriented in parallel and exhibit the essential morphological features of the original matrix component and of the interspersed undeformed, co-deformed or fragmented reinforcing component.

2. The process according to claim 1, whereby the matrix component is made from Nb or Ta or alloys thereof, and the reinforcing component is a carbide, oxide or nitride of Ti, Zr or Hf, or a mixture thereof.

3. The process according to claim 1, whereby the matrix component is made from Mo or W or alloys thereof, and the reinforcing component is a carbide, oxide or nitride of Ti, Zr or Hf, or a mixture thereof.

4. The process according to any one of the claims 1 to 3, whereby the compaction is carried out via Hot Isostatic Pressing.

5. The process according to claim 4, whereby after compaction the material is mechanically deformed with a degree of deformation between 10% and 40%.

6. The process according to any one of the claims 1 to 3, whereby the compaction is performed by way of mechanical deformation.

7. The process according to claim 6, whereby the deformation is carried out to a degree of 50%–70%.

8. The process according to any one of the claims 1 to 3, whereby the morphology of the composite material is modified during a subsequent heat treatment.

9. The process according to claim 4, whereby the morphology of the composite material is modified during a subsequent heat treatment.

10. The process according to claim 5, whereby the morphology of the composite material is modified during a subsequent heat treatment.

11. The process according to claim 6, whereby the morphology of the composite material is modified during a subsequent heat treatment.

12. The process according to claim 7, whereby the morphology of the composite material is modified during a subsequent heat treatment.

* * * * *